US009508292B2

(12) United States Patent
Xie

(10) Patent No.: US 9,508,292 B2
(45) Date of Patent: Nov. 29, 2016

(54) PIXEL DRIVING CIRCUIT AND DRIVING METHOD THEREOF, AND DISPLAY DEVICE

(71) Applicant: BOE TECHNOLOGY GROUP CO., LTD., Beijing (CN)

(72) Inventor: Hongjun Xie, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 28 days.

(21) Appl. No.: 14/415,469

(22) PCT Filed: Apr. 11, 2014

(86) PCT No.: PCT/CN2014/075181

§ 371 (c)(1),
(2) Date: Jan. 16, 2015

(87) PCT Pub. No.: WO2015/096299

PCT Pub. Date: Jul. 2, 2015

(65) Prior Publication Data

US 2015/0356928 A1 Dec. 10, 2015

(30) Foreign Application Priority Data

Dec. 26, 2013 (CN) ..... 2013 1 0739543

(51) Int. Cl.
*G09G 3/34* (2006.01)
*G09G 3/32* (2016.01)
(Continued)

(52) U.S. Cl.
CPC ..... *G09G 3/3413* (2013.01); *G09G 3/2074* (2013.01); *G09G 3/3225* (2013.01);
(Continued)

(58) Field of Classification Search
CPC ..... G09G 3/3225; G09G 3/3413; G09G 3/3258; G09G 3/3266; G09G 3/2074; G09G 3/3648
See application file for complete search history.

(56) References Cited

U.S. PATENT DOCUMENTS 5,436,747 A 7/1995 Suzuki
6,833,888 B2 * 12/2004 Song ..... G09G 3/3607 349/106
2007/0195047 A1 * 8/2007 Cho ..... G09G 3/3648 345/98

FOREIGN PATENT DOCUMENTS

CN 1637823 A 7/2005
CN 101017644 A 8/2007
(Continued)

OTHER PUBLICATIONS

Search Report issued in International Application No. PCT/CN2014/075181, dated Nov. 4, 2014 (Nov. 4, 2014).
(Continued)

*Primary Examiner* — Shaheda Abdin
(74) *Attorney, Agent, or Firm* — Nath, Goldberg & Meyer; Joshua B. Goldberg; Christopher Thomas

(57) ABSTRACT

The present invention provides a pixel driving circuit and a driving method thereof, and a display device. The pixel driving circuit is used for driving a pixel array, wherein each pixel in the pixel array comprises four sub-pixels with different colors, and wherein the pixel driving circuit comprises: at least one first sub-pixel driving chip and at least one second sub-pixel driving chip, wherein the at least one first sub-pixel driving chip each is connected to a part of sub-pixels corresponding thereto in corresponding pixels to drive them, and the at least one second sub-pixel driving chip each is connected to the other part of sub-pixels corresponding thereto in the corresponding pixels to drive them. In the invention, noise interference can be avoided, and the display quality is improved; the cost is reduced; signal transmitting efficiency is increased and the EMI characteristic of products is improved.

10 Claims, 6 Drawing Sheets

(51) Int. Cl.

| | |
|---|---|
| ***G09G 3/20*** | (2006.01) |
| ***G09G 3/36*** | (2006.01) |
| *G09G 5/18* | (2006.01) |

(52) U.S. Cl.

CPC ..... *G09G3/3258* (2013.01); *G09G 3/3266* (2013.01); *G09G 3/3648* (2013.01); *G09G 5/18* (2013.01); *G09G 2300/0426* (2013.01); *G09G 2300/0452* (2013.01); *G09G 2300/0828* (2013.01); *G09G 2310/0281* (2013.01); *G09G 2320/0223* (2013.01); *G09G 2320/0276* (2013.01); *G09G 2320/0673* (2013.01); *G09G 2330/028* (2013.01); *G09G 2330/06* (2013.01)

(56) References Cited

FOREIGN PATENT DOCUMENTS

| | | | |
|---|---|---|---|
| CN | 101093640 | B | 1/2011 |
| KR | 20040079562 | A | 9/2004 |

OTHER PUBLICATIONS

Second Office Action dated Nov. 24, 2015 corresponding to Chinese application No. 201310739543.0.

Written Opinion of the International Searching Authority dated Aug. 11, 2014 corresponding to International application No. PCT/CN2014/075181.

* cited by examiner

PIXEL DRIVING CIRCUIT AND DRIVING METHOD THEREOF, AND DISPLAY DEVICE

This is a National Phase Application filed under 35 U.S.C. 371 as a national stage of PCT/CN2014/075181, filed Apr. 11, 2014, an application claiming the benefit to Chinese Application No. 201310739543.0, filed Dec. 26, 2013; the content of each of which is hereby incorporated by reference in its entirety.

FIELD OF THE INVENTION

The present invention relates to the field of display technology, and particularly relates to a pixel driving circuit and a driving method thereof, and a display device.

BACKGROUND OF THE INVENTION

Design of modules of a display device adopting Active Matrix/Organic Light Emitting Diode (AMOLED) is quite complicated, and when a resolution of the display device is increased to more than 3840×2160 (large-size display), a design of four sub-pixels with different colors (that is, Red, Green, Blue and White, RGBW for short) is generally adopted. For the design of four sub-pixels with different colors, a gate/source double-driving method is generally used. FIG. 1 shows a schematic diagram of a driving circuit for four sub-pixels with different colors in the prior art, as shown in FIG. 1, the pixel driving circuit in the prior art comprises: a first driving circuit board, a second driving circuit board and a pixel array, wherein the first driving circuit board comprises several first sub-pixel driving chips 201, the second driving circuit board comprises several second sub-pixel driving chips 301, and the pixel array comprises several pixels. Furthermore, each pixel comprises a red sub-pixel 101, a green sub-pixel 102, a blue sub-pixel 103 and a white sub-pixel 104, wherein one first sub-pixel driving chip and one second sub-pixel driving chip are provided corresponding to several pixels, that is, each of the first sub-pixel driving chips is connected to all of the red sub-pixel, the green sub-pixel, the blue sub-pixel and the white sub-pixel of a pixel corresponding thereto, and each of the second sub-pixel driving chips is connected to all of the red sub-pixel, the green sub-pixel, the blue sub-pixel and the white sub-pixel of a pixel corresponding thereto, each sub-pixel is connected to a pin of a pixel driving chip corresponding thereto. In general, the first sub-pixel driving chip and the second sub-pixel driving chip refer to X-direction circuit boards and are provided at upper portion or lower portion of the display panel of the display device respectively.

Each of the sub-pixel driving chips comprises four set of DA converters, which correspond to the above-mentioned four sub-pixels with different colors, that is to say, each set of DA converters correspond to sub-pixels of one color and correspond to one set of Gamma voltage supplies, each set of Gamma voltage supplies occupies 9, 8 or 7 pins of the sub-pixel driving chip. Taking one set of Gamma voltage supplies occupying 9 pins as an example, four sets of Gamma voltage supplies for one pixel occupy 36 pins. Since signal lines for Gamma voltage supplies are exposed outside, large number of Gamma voltage supplies may result in large amount of noise, which may affect the display quality. In addition, the sub-pixel driving chip is expensive in cost, use of its pins should be saved as far as possible. Also, the pixel driving circuit in the prior art will use a large number of sub-pixel driving chips to satisfy requirements on pins, thus too many devices may result in a large-sized display device, and it is difficult to meet the requirements on thin and compact design of display device.

SUMMARY OF THE INVENTION

In order to solve problems of a large amount of noise due to too many Gamma voltage supplies and thus the display quality is decreased in the prior art, and reduce used pins of the sub-pixel driving chip, decrease the number of the sub-pixel driving chips to meet the requirements on thin and compact design of the display device, the present invention provides a pixel driving circuit and a driving method thereof. In the present invention, by adopting a source single-driving method, the used pins of the sub-pixel driving chip are reduced, and thus the number of the Gamma voltage supplies is decreased, the display quality is improved, the number of the sub-pixel driving chips is reduced, and thus the requirements on thin and compact design of the display device is met.

The present invention provides a pixel driving circuit for driving a pixel array, wherein each pixel in the pixel array comprises four sub-pixels with different colors, and wherein the pixel driving circuit comprises at least one first sub-pixel driving chip and at least one second sub-pixel driving chip, wherein the at least one first sub-pixel driving chip each is connected to a part of sub-pixels corresponding thereto in corresponding pixels to drive them, and the at least one second sub-pixel driving chip each is connected to the other part of sub-pixels corresponding thereto in the corresponding pixels to drive them.

The four sub-pixels in each pixel are a red sub-pixel, a green sub-pixel, a blue sub-pixel and a white sub-pixel respectively.

Furthermore, in each pixel in the pixel array, the sub-pixels are arranged side by side in one row in the pixel array; the at least one first sub-pixel driving chip each is connected to two sub-pixels in each corresponding pixel, and the at least one second sub-pixel driving chip each is connected to the other two sub-pixels in each corresponding pixel;

or the sub-pixels in each pixel in the pixel array are arranged in 2×2 matrix, the at least one first sub-pixel driving chip each is connected to two sub-pixels in the same column in each corresponding pixel, and the at least one second sub-pixel driving chip each is connected to the other two sub-pixels in the other column in each corresponding pixel.

Furthermore, the pixel driving circuit further comprises a timing controller, the at least one first sub-pixel driving chip and the at least one second sub-pixel driving chip are connected to the timing controller respectively, the timing controller enables the first sub-pixel driving chip and the second sub-pixel driving chip for the same corresponding pixel to apply driving voltages to the sub-pixels in the corresponding pixel simultaneously.

Furthermore, the timing controller transmits, to each of the at least one first sub-pixel driving chip, Gamma voltage signals for the two sub-pixels in each of the corresponding pixels to be driven by the first sub-pixel driving chip, and the timing controller transmits, to each of the at least one second sub-pixel driving chip, Gamma voltage signals for the other two sub-pixels in each of the corresponding pixels to be driven by the second sub-pixel driving chip.

The pixel driving circuit further comprises digital/analog converters, wherein each of the at least one first sub-pixel driving chip is provided with two sets of digital/analog converters for receiving the Gamma voltage signals for the two sub-pixels of each of the corresponding pixels, and applying driving voltages to the two sub-pixels in each corresponding pixel one to one; and each of the at least one second sub-pixel driving chip is provided with two sets of digital/analog converters for receiving the Gamma voltage signals for the other two sub-pixels of each of the corresponding pixels, and applying driving voltages to the other two sub-pixels in each of the corresponding pixels one to one.

Specifically, the two sets of digital/analog converters in each of the at least one first sub-pixel driving chip are connected to sources of light-emitting devices of the two sub-pixels of each of the corresponding pixels one to one; and the two sets of digital/analog converters in each of the at least one second sub-pixel driving chip are connected to sources of light-emitting devices of the other two sub-pixels of each of the corresponding pixels one to one.

The present invention also provides a driving method of the above-described pixel driving circuit, the driving method comprises:

the at least one first sub-pixel driving chip and the at least one second sub-pixel driving chip receive scan controlling signals transmitted from the timing controller, each of the at least one first sub-pixel driving chip applies driving signals to part of sub-pixels in the corresponding pixels to be driven by itself, while corresponding second sub-pixel driving chip applies driving signals to the other part of sub-pixels in the corresponding pixels to be driven by itself.

The present invention further provides a display device comprising the above-described pixel driving circuit.

The present invention provides a pixel driving circuit and a driving method thereof, and a display device, by performing source single-driving on sub-pixels by the sub-pixel driving chips which are provided opposite to each other, respectively, the used pins of the sub-pixel driving chip are reduced, advantageous effect of the present invention specifically includes:

I. pins occupied by the Gamma voltage supplies are reduced, thus the number of the Gamma voltage supplies is decreased, a large amount of noise is avoided, and the display quality is improved;

II. the number of the D/A converters of each sub-pixel driving chip is reduced, thus the number of the sub-pixel driving chips is reduced, the cost is reduced, the size of display device is reduced, therefore, requirements on thin and compact design of the display device is met;

III. the frequency of the display signal may be decreased to a half of that in the prior art by source single-driving, signal transmitting efficiency is increased and thus the EMI (Electro Magnetic Interference) characteristic of products is improved; and IV. size and cost of the chip is largely reduced and the entire performance of the display device is improved.

DETAILED DESCRIPTION OF THE EMBODIMENTS

In order to better understand the present invention, the present invention will be further described in conjunction with accompanying drawings and specific embodiments.

Figure 1:
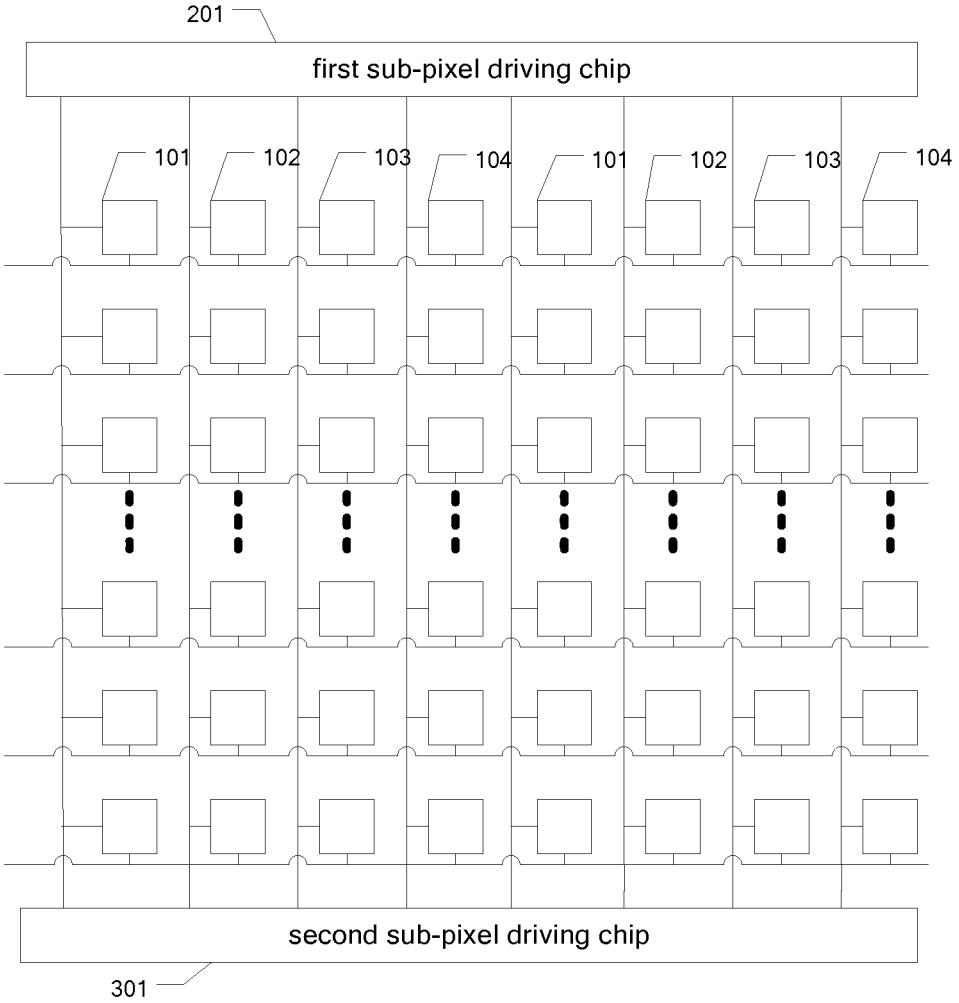
FIG. 1 is a schematic diagram of a driving circuit for four sub-pixels with different colors in the prior art.
Figure 2:
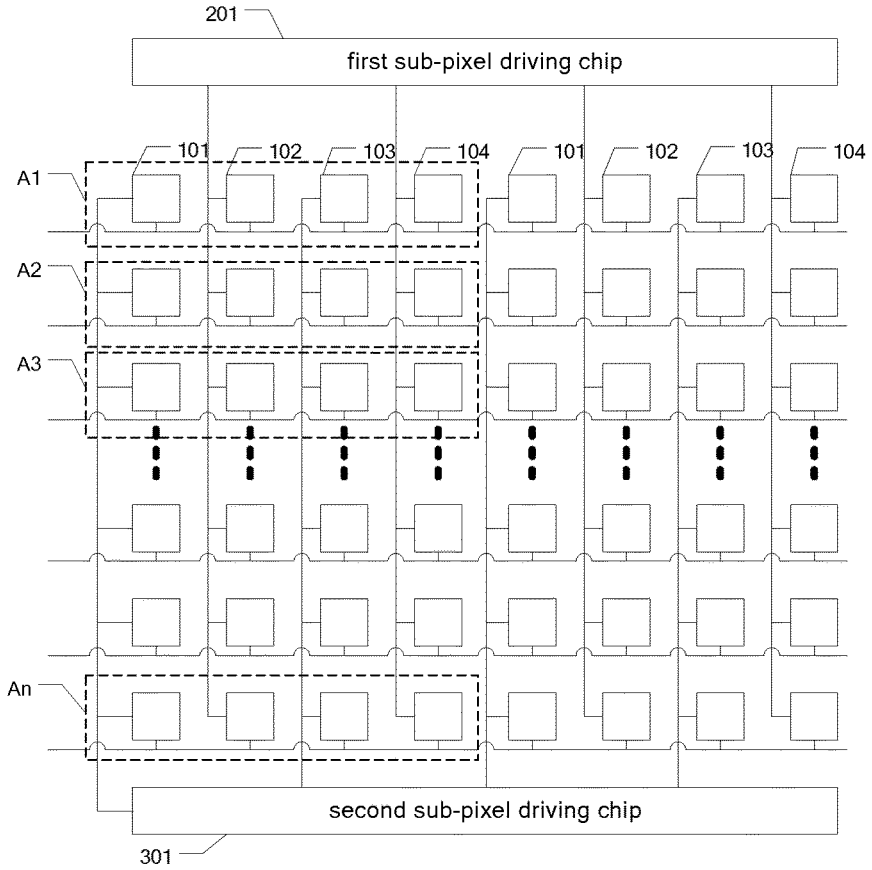
FIG. 2 is a structural schematic diagram of a pixel driving circuit in an embodiment of the present invention.

An embodiment of the present invention provides a pixel driving circuit, FIG. 2 is a structural schematic diagram of a pixel driving circuit in the embodiment of the present invention, as shown in FIG. 2, the pixel driving circuit is applied to drive a pixel array, each pixel in the pixel array comprises four sub-pixels with different colors with each other, the sub-pixels are arranged in rows, and the pixel driving circuit provides scan controlling signals row by row.

The pixel driving circuit comprises: a first sub-pixel driving chip 201 and a second sub-pixel driving chip 301, wherein the first sub-pixel driving chip 201 is connected to part of sub-pixels in each pixel, while the second sub-pixel driving chip 301 is connected to the other part of sub-pixels in each pixel. It should be noted that in drawings, only one first sub-pixel driving chip 201 and one second sub-pixel driving chip 301 are shown, and following embodiments will be described by taking one first sub-pixel driving chip 201 and one second sub-pixel driving chip 301 as example, however, the numbers of the first sub-pixel driving chip 201 and the second sub-pixel driving chip 301 are not limited thereto, but may be arbitrarily set as desired. In addition, in following embodiments, description will be given with reference to the first sub-pixel driving chip 201 and the second sub-pixel driving chip 301 driving four sub-pixels in one pixel in one row, and driving the sub-pixels in each of pixels in one column simultaneously, but the present invention is not limited thereto. In fact, the first sub-pixel driving chip 201 and the second sub-pixel driving chip 301, based on the number of output channels thereof, may simultaneously drive a plurality of pixels in one row and may simultaneously drive each of pixels in one column (as shown in FIG. 2, pixels A1, A2 . . . An are driven simultaneously).

The first sub-pixel driving chip 201 and the second sub-pixel driving chip 301 may simultaneously provide driving voltages to sub-pixels, in one row, of pixels in the pixel array. The pixel driving circuit is applied to drive a pixel array, each pixel in the pixel array comprises four sub-pixels with different colors with each other.

Specifically, in the pixel driving circuit according to the embodiment of the present invention, the four sub-pixels in each pixel comprises a red sub-pixel 101, a green sub-pixel 102, a blue sub-pixel 103 and a white sub-pixel 104.

In the prior art, when the pixel driving circuit operating in a gate/source double-driving manner drives four sub-pixels, each sub-pixel driving chip is connected to the four sub-pixels, for example, the first sub-pixel driving chip is connected to all of four sub-pixels of the red sub-pixel, the green sub-pixel, the blue sub-pixel and the white sub-pixel, meanwhile, the second sub-pixel driving chip is also connected to the four sub-pixels. Furthermore, each sub-pixel needs a set of digital/analog converters, accordingly, in each of the first sub-pixel driving chip and the second sub-pixel driving chip, it is necessary to provide a set of Gamma voltages for each color, that is, each sub-pixel driving chip needs four sets of Gamma voltages. For example, each set of Gamma voltages occupies 9 pins of the sub-pixel driving chip, therefore, 36 pins in each of the first sub-pixel driving chip and the second sub-pixel driving chip will be occupied.

In the pixel driving circuit operating in a source single-driving manner provided by the present invention, as shown in FIG. 2, the first sub-pixel driving chip 201 is connected to part of sub-pixels in each of pixels to be driven by itself, for example, to the green sub-pixel 102 and the white sub-pixel 104 respectively as shown in FIG. 2. Meanwhile, the second sub-pixel driving chip 301 is connected to the other part of sub-pixels in each of the pixels, that is, to the red sub-pixel 101 and the blue sub-pixel 103. From above description, it can be seen that the two sub-pixel driving chips may provide voltages to sub-pixels in the same row in one pixel, therefore, on the whole, the number of pins to be occupied in the sub-pixel driving chips is reduced by half, the number of signal connection lines for Gamma voltages is reduced, the design of the chip is simplified, and the complex and cost of the chip are decreased.

Specifically, in the pixel driving circuit according to the embodiment of the present invention, both of the first sub-pixel driving chip and the second sub-pixel driving chip are connected to a timing controller, and the timing controller enables the first sub-pixel driving chip and the second sub-pixel driving chip to provide driving voltages to four sub-pixels in one pixel simultaneously.

Figure 3:
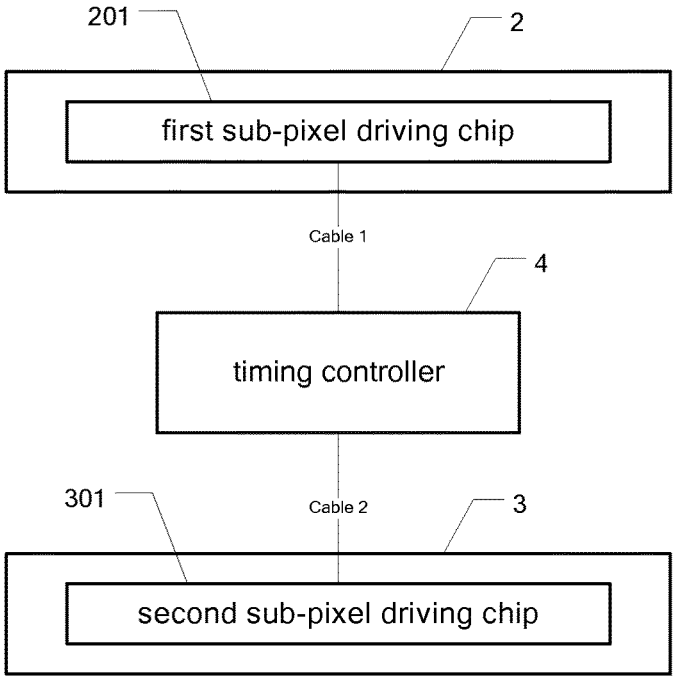
FIG. 3 is a schematic diagram illustrating a timing controller being connected to a first sub-pixel driving chip and a second sub-pixel driving chip, according to an embodiment of the present invention.

FIG. 3 is a schematic diagram illustrating a timing controller being connected to a first sub-pixel driving chip and a second sub-pixel driving chip according to an embodiment of the present invention. As shown in FIG. 3, a first driving circuit board 2 comprises the first sub-pixel driving chip 201, a second driving circuit board 3 comprises the second sub-pixel driving chip 301, the first sub-pixel driving chip 201 is connected to a timing controller 4, and the second sub-pixel driving chip 301 is also connected to the timing controller 4. The timing controller 4 refer to a TCON, in order to enable four sub-pixels in each pixel to operate normally so as to form an operating unit of one entire pixel, it is necessary to cooperate the first sub-pixel driving chip and the second sub-pixel driving chip in harmony, so that the effect resulting from using the first sub-pixel driving chip and the second sub-pixel driving chip to provide driving voltages is the same as that resulting from using one sub-pixel driving chip to provide driving voltages to all of four sub-pixels in one pixel. The timing controller adopted in the present invention is responsible for cooperating the first sub-pixel driving chip and the second sub-pixel driving chip in harmony, the timing controller enables the first sub-pixel driving chip and the second sub-pixel driving chip to simultaneously provide driving voltages to sub-pixels in the same row of one pixel so as to achieve operating performance of one entire pixel.

Specifically, in the pixel driving circuit of the present invention, the first sub-pixel driving chip 201 and the second sub-pixel driving chip 301 are connected to the timing controller in manners including FFC (Flexible Flat Cable) connection, FPC (Flexible Printed Circuit) connection and wiring harness connections such as CABLE.

Specifically, in the pixel driving circuit of the present invention:

the timing controller transmits Gamma voltage signals for two sub-pixels in one pixel to the first sub-pixel driving chip, and the timing controller transmits Gamma voltage signals for the other two sub-pixels in the one pixel to the second sub-pixel driving chip, wherein the pixel driving circuit comprises four sets of digital/analog converters, and wherein the first sub-pixel driving chip is provided with two sets of digital/analog converters for receiving the Gamma voltage signals for two sub-pixels in each of pixels to be driven by the first sub-pixel driving chip, and applying driving voltages to the two sub-pixels in each of the pixels one to one;

the second sub-pixel driving chip is provided with two sets of digital/analog converters for receiving the Gamma voltage signals for the other two sub-pixels in each of the pixels, and applying driving voltages to the other two sub-pixels in each of the pixels one to one.

The digital/analog converter is used for converting digital Gamma voltage signal into analog voltage signal, and converting image data into analog voltage. The Gamma voltage signal may generate grayscale voltages necessary for screen display, so that the display has a sense of layering.

Furthermore, in the pixel driving circuit in the embodiment of the present invention, the first sub-pixel driving chip is connected to sources of light-emitting devices of the two sub-pixels of each of the pixels to be driven by itself; and the second sub-pixel driving chip is connected to sources of light-emitting devices of the other two sub-pixels of each of the pixels to be driven by itself.

Since the pixel driving circuit of the present invention adopts a source single-driving manner, that is, the first sub-pixel driving chip and the second sub-pixel driving chip transmit different display data respectively at the same time, as a result, the frequency of the display signal may be decreased to a half of that in the prior art, signal transmitting efficiency is increased and thus the EMI characteristic of products is improved.

Optionally, in the pixel array in the pixel driving circuit in the embodiment of the present invention, the pixels may be arranged in a stripe manner as it is in the above-described embodiment or a square (2×2 matrix) manner.

Since the pixels in the pixel array of display device generally arranged in the above-described two manners, embodiment 1 and embodiment 2 of the present invention will be described in more details below for one of the two arrangement manners respectively. However, regardless of arrangement manners, the effect of the present invention may be realized as long as dividing sub-pixels in each pixel into two parts, connecting one part to the first sub-pixel driving chip and connecting the other part to the second sub-pixel driving chip.

Embodiments of the present invention also provide a driving method of pixel driving circuit for driving the pixel driving circuit of the present invention, the driving method comprises:

the first sub-pixel driving chip and the second sub-pixel driving chip receive scan controlling signals transmitted from the timing controller, the first sub-pixel driving chip applies driving signals to part of sub-pixels in each of the pixels to be driven by itself, while the second sub-pixel driving chip applies driving signals to the other part of sub-pixels in the pixels to be driven by itself.

The timing controller divides the data for each pixel into two groups, one of which is a first scan controlling signal for the first sub-pixel driving chip and is transmitted to the first sub-pixel driving chip, and the other one of which is a second scan controlling signal for the second sub-pixel driving chip and is transmitted to the second sub-pixel driving chip. Thus, the first sub-pixel driving chip and the second sub-pixel driving chip may cooperate to achieve voltage driving of one entire pixel.

Specifically, in the driving method in the embodiment of the present invention, the timing controller provides scan controlling signals to every row of pixels sequentially.

For example, for a display device with a resolution of 3840×2160, its pixel array includes 3840 columns and 2160 rows. For each frame of image, the timing controller is required to provide scan controlling signals so that every pixel can be scanned, the timing controller provides scan controlling signals to every row of pixels sequentially, for example, in an order from the top row to the bottom row, and further for 2160 rows of pixels, the scan controlling signal is applied 2160 times, each scan controlling signal controls one row of pixels.

Embodiments of the invention further provide a display device, such as liquid crystal panel, tablet computer, display of mobile phone, which comprising the above-described pixel driving circuit.

Embodiment 1

Figure 4:
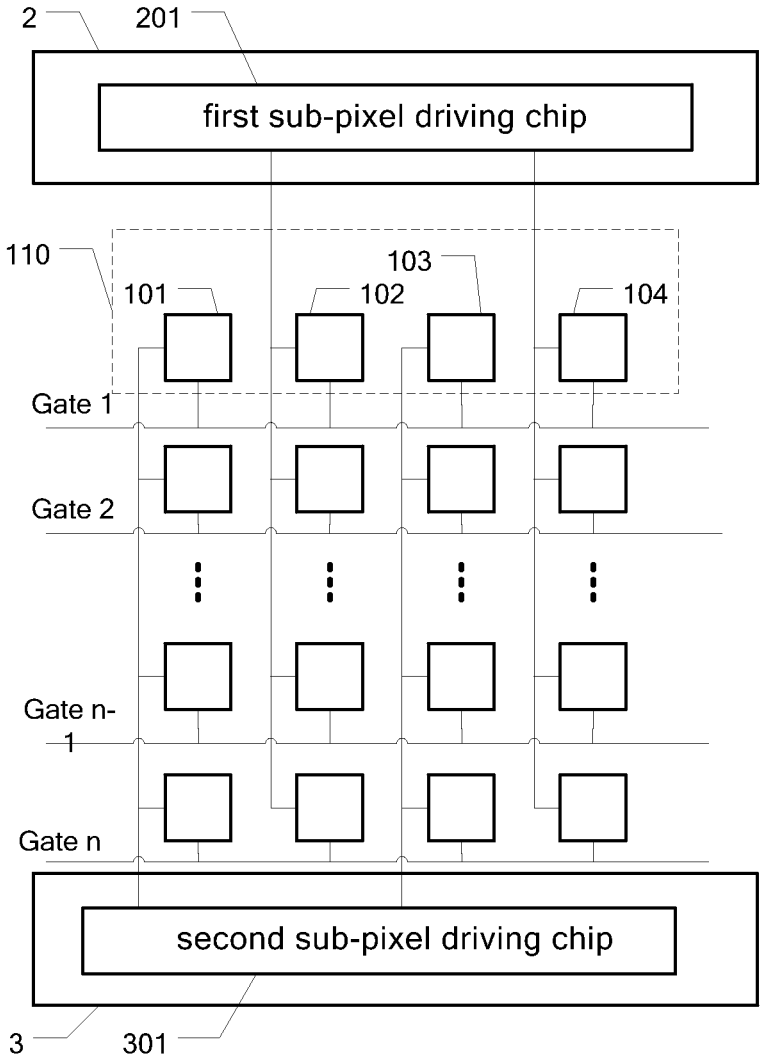
FIG. 4 is a structural schematic diagram of a pixel driving circuit in the embodiment 1 of the present invention.

The pixel driving circuit in the embodiment 1 of the present invention is applied to a pixel array in a stripe arrangement manner, in which sub-pixels in each pixel are arranged in the same row. FIG. 4 is a structural schematic diagram of a pixel driving circuit in the embodiment 1 of the invention. As shown in FIG. 4, for example, four sub-pixels are arranged in one row in the order of red, green, blue and white so as to form a pixel 110. A first sub-pixel driving chip 201 is provided on a first driving circuit board 2, a second sub-pixel driving chip 301 is provided on a second driving circuit board 3, the first driving circuit board 2 is a X-direction circuit board and provided above the display screen of the display device, the second driving circuit board 3 is a X-direction circuit board and provided below the display screen of the display device. The green sub-pixel 102 and the white sub-pixel 104 are connected to the first sub-pixel driving chip 201 respectively, and the red sub-pixel 101 and the blue sub-pixel 103 are connected to the second sub-pixel driving chip 301 respectively. As such, sub-pixels in other rows may be connected to the first sub-pixel driving chip 201 and the second sub-pixel driving chip 301 respectively in the same manner. In addition, a gate line Gate 1 is connected to the pixels 110 in the first row, one of which is enclosed by a dot line frame in FIG. 4, a gate line Gate 2 is connected to the pixels in the second row, . . . , and so on, a gate line Gate n is connected to the pixels in the n-th row.

For one pixel, each sub-pixel driving chip only needs two sets of inner digital/analog converters, and reserves pins for only two sets of Gamma voltages, therefore, design of the chip is simplified and complex and cost of the chip is decreased. For example, as each Gamma voltage needs 9 pins, it is only necessary for the first sub-pixel driving chip to reserve 18 pins for the green sub-pixel and the white sub-pixel, and it is only necessary for the second sub-pixel driving chip to reserve 18 pins for the red sub-pixel and the blue sub-pixel, thus the number of signal connection lines is reduced, and the display quality is improved.

Figure 5:
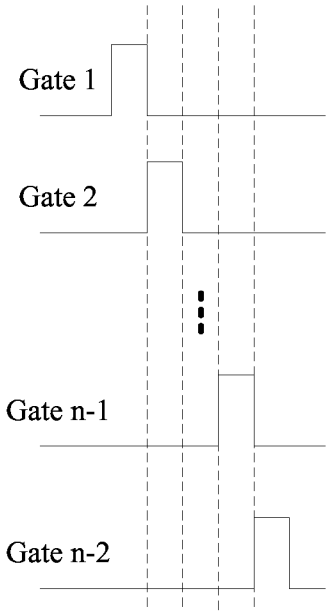
FIG. 5 is a timing diagram of gate lines in the embodiment 1.

The timing controller provides a scan controlling signal for progressive scanning, for example, in a case of a large-sized display device with a resolution of 3840×2160, in progressive scanning all pixels for one frame of image, the scan time for one frame of image includes 2160 time periods, and in each time period, sub-pixels are turned on and charged, only one row of pixels is in status of being turned on and charged at any time period. Specifically, when the timing controller enables the pixel driving circuit to scan one row of pixels, the first sub-pixel driving chip charges the green sub-pixel and the white sub-pixel, while the second sub-pixel driving chip charges the red sub-pixel and the blue sub-pixel. At any time, the first sub-pixel driving chip and the second sub-pixel driving chip charge respective sub-pixels in the same row simultaneously. FIG. 5 is a timing diagram of gate lines in the embodiment 1, as shown in FIG. 5, when scanning the first row of pixels, the level of the gate line Gate 1 is high, when scanning the second row of pixels, the level of the gate line Gate 2 is high, . . . , and so on, when scanning the n-th row of pixels, the level of the gate line Gate n is high.

The timing controller is connected to the first sub-pixel driving chip 201 and the second sub-pixel driving chip 301, for example, in a Cable manner, the timing controller provides Gamma voltages for the green sub-pixel 102 and the white sub-pixel 104 to the first sub-pixel driving chip 201 through line Cable 1, while the timing controller provides Gamma voltages for the red sub-pixel 101 and the blue sub-pixel 103 to the second sub-pixel driving chip 301 through line Cable 2. In the timing controller, scan data of each pixel is divided into two groups, one of which inputs display data of the green sub-pixel 102 and the white sub-pixel 104 into the first sub-pixel driving chip 201 through the line Cable 1, the other one of which inputs display data of the red sub-pixel 101 and the blue sub-pixel 103 into the second sub-pixel driving chip 301 through the line Cable 2.

In the embodiment, the sub-pixels forming the pixels are driven in a source single-driving manner, that is, the first sub-pixel driving chip is connected to sources of light-emitting devices of the green sub-pixel and the white sub-pixel; the second sub-pixel driving chip is connected to sources of light-emitting devices of the red sub-pixel and the blue sub-pixel, so that the frequency of the display signal is decreased by half, thus the signal quality and the EMI characteristic of products are improved.

Embodiment 2

Figure 6:
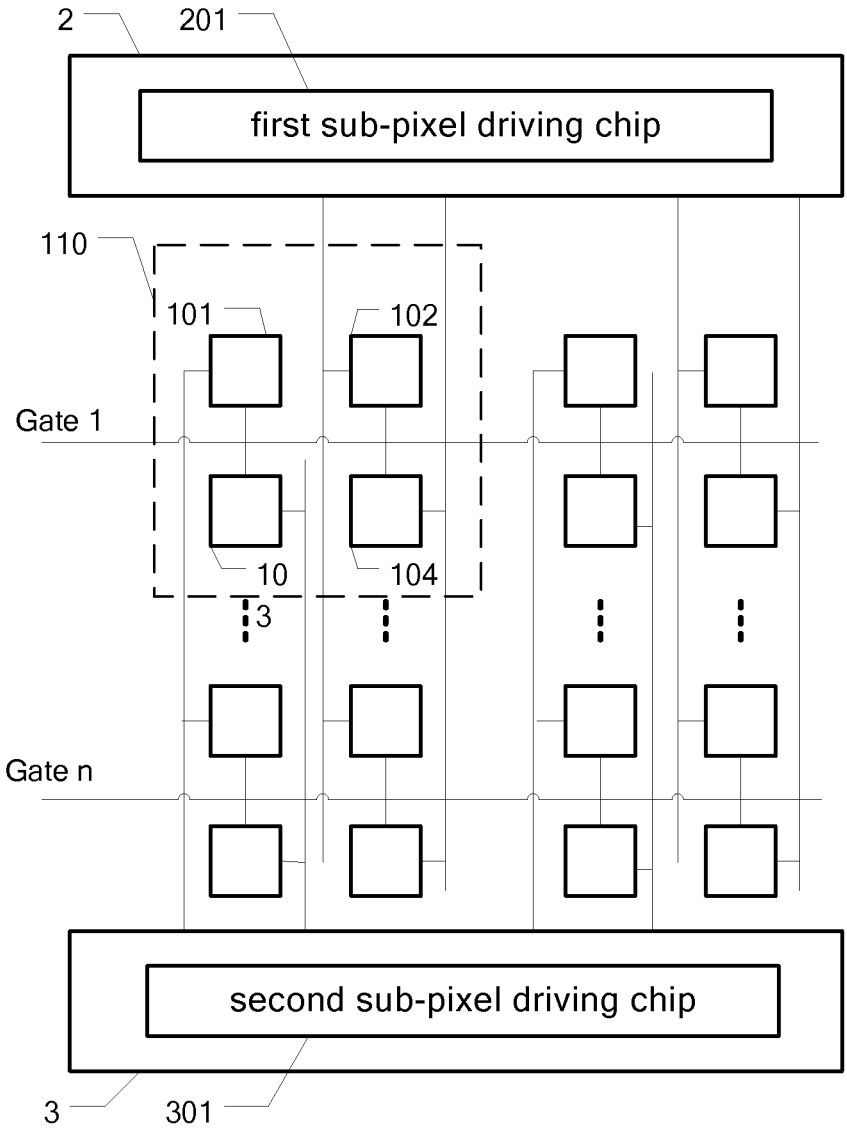
FIG. 6 is a structural schematic diagram of a pixel driving circuit in the embodiment 2 of the present invention.

The pixel driving circuit in the embodiment 2 is similar to that in the embodiment 1, difference between them is that the pixel driving circuit in the embodiment 2 is applied to a pixel array in a square (2×2 matrix) arrangement. FIG. 6 is a structural schematic diagram of the pixel driving circuit in the embodiment 2 of the present invention, as shown in FIG. 6, for example, in a pixel 110, the red sub-pixel 101 is located above the blue sub-pixel 103, the green sub-pixel 102 is located above the white sub-pixel 104, the red sub-pixel 101 and the green sub-pixel 102 are located at upper portion of the pixel, and the blue sub-pixel 103 and the white sub-pixel 104 are located at lower portion of the pixel. The green sub-pixel 102 and the white sub-pixel 104 are connected to the first sub-pixel driving chip 201 respectively, while the red sub-pixel 101 and the blue sub-pixel 103 are connected to the second sub-pixel driving chip 301 respectively. The first sub-pixel driving chip 201 is provided on the first driving circuit board 2, and the second sub-pixel driving chip 301 is provided on the second driving circuit board 3. The gate line Gate 1 is connected to the pixels 110 in the first row, one of which is enclosed by a dot line frame in FIG. 6, . . . , and so on, the gate line Gate n is connected to the pixels in the n-th row.

Figure 7:
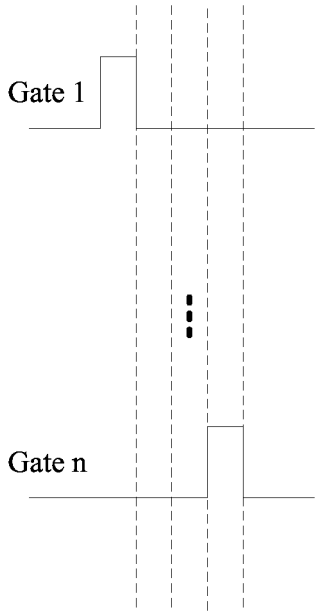
FIG. 7 is a timing diagram of gate lines in the embodiment 2.

When the timing controller enables the pixel driving circuit to scan pixels, the first sub-pixel driving chip 201 charges the green sub-pixel 102 and the white sub-pixel 104, and the second sub-pixel driving chip 301 charges the red sub-pixel 101 and the blue sub-pixel 103. At any time, the first sub-pixel driving chip 201 and the second sub-pixel driving chip 301 charge sub-pixels in the same row simultaneously. FIG. 7 is a timing diagram of gate lines in the embodiment 2, as shown in FIG. 7, when scanning the first row of pixels, the level of the gate line Gate 1 is high, . . . , and so on, when scanning the n-th row of pixels, the level of the gate line Gate n is high.

It should be understood that, the forgoing embodiments are merely the preferred embodiments of the present invention, and other embodiments of the present invention are possible. Persons skilled in the art may make various modifications and improvements according to the present invention without departing from the spirit and essence of the present invention, and these modifications and improvements should belong to the protection scope of the present invention which is defined by the appended claims.

The invention claimed is:

1. A pixel driving circuit for driving a pixel array, wherein each pixel in the pixel array comprises four sub-pixels with different colors, and wherein the pixel driving circuit comprises at least one first sub-pixel driving chip and at least one second sub-pixel driving chip, wherein the at least one first sub-pixel driving chip each is connected to a part of sub-pixels corresponding thereto in corresponding pixels to drive them, and the at least one second sub-pixel driving chip each is connected to the other part of sub-pixels corresponding thereto in the corresponding pixels to drive them;

wherein in each pixel in the pixel array, the sub-pixels are arranged side by side in one row in the pixel array; the at least one first sub-pixel driving chip each is connected to two sub-pixels in each corresponding pixel, and the at least one second sub-pixel driving chip each is connected to the other two sub-pixels in each corresponding pixel; and wherein the pixel driving circuit further comprises a timing controller, the at least one first sub-pixel driving chip and the at least one second sub-pixel driving chip are connected to the timing controller respectively, the timing controller enables the first sub-pixel driving chip and the second sub-pixel driving chip for the same corresponding pixel to apply driving voltages to the sub-pixels in the corresponding pixel simultaneously.

2. The pixel driving circuit of claim 1, wherein the four sub-pixels in each pixel are a red sub-pixel, a green sub-pixel, a blue sub-pixel and a white sub-pixel respectively.

3. The pixel driving circuit of claim 1, wherein the sub-pixels in each pixel in the pixel array are arranged in 2×2 matrix, the at least one first sub-pixel driving chip each is connected to two sub-pixels in the same column in each corresponding pixel respectively, and the at least one second sub-pixel driving chip each is connected to the other two sub-pixels in the other column in each corresponding pixel respectively.

4. The pixel driving circuit of claim 1, wherein the timing controller transmits, to each of the at least one first sub-pixel driving chip, Gamma voltage signals for the two sub-pixels in each of the corresponding pixels to be driven by the first sub-pixel driving chip, and the timing controller transmits, to each of the at least one second sub-pixel driving chip, Gamma voltage signals for the other two sub-pixels in each of the corresponding pixels to be driven by the second sub-pixel driving chip.

5. The pixel driving circuit of claim 1, further comprises digital/analog converters, wherein each of the at least one first sub-pixel driving chip is provided with two sets of digital/analog converters for receiving the Gamma voltage signals for the two sub-pixels in each of the corresponding pixels, and applying driving voltages to the two sub-pixels in each of the corresponding pixels one to one; and each of the at least one second sub-pixel driving chip is provided with two sets of digital/analog converters for receiving the Gamma voltage signals for the other two sub-pixels in each of the corresponding pixels, and applying driving voltages to the other two sub-pixels in each of the corresponding pixels one to one.

6. The pixel driving circuit of claim 5, wherein the two sets of digital/analog converters in each of the at least one first sub-pixel driving chip are connected to sources of light-emitting devices of the two sub-pixels of each of the corresponding pixels one to one; and the two sets of digital/analog converters in each of the at least one second sub-pixel driving chip are connected to sources of light-emitting devices of the other two sub-pixels of each of the corresponding pixels one to one.

7. A driving method of pixel driving circuit of claim 1, comprising:

the at least one first sub-pixel driving chip and the at least one second sub-pixel driving chip receive scan controlling signals transmitted from the timing controller, each of the at least one first sub-pixel driving chip applies driving signals to part of sub-pixels in the corresponding pixels to be driven by itself, while corresponding second sub-pixel driving chip applies driving signals to the other part of sub-pixels in the corresponding pixels to be driven by itself.

8. A display device, which comprises a pixel driving circuit for driving a pixel array, wherein each pixel in the pixel array comprises four sub-pixels with different colors, and wherein the pixel driving circuit comprises at least one first sub-pixel driving chip and at least one second sub-pixel driving chip, wherein the at least one first sub-pixel driving chip each is connected to a part of sub-pixels corresponding thereto in corresponding pixels to drive them, and the at least one second sub-pixel driving chip each is connected to the other part of sub-pixels corresponding thereto in the corresponding pixels to drive them;

wherein the sub-pixels in each pixel in the pixel array are arranged in 2×2 matrix, the at least one first sub-pixel driving chip each is connected to two sub-pixels in the same column in each corresponding pixel respectively, and the at least one second sub-pixel driving chip each is connected to the other two sub-pixels in the other column in each corresponding pixel respectively; and wherein the pixel driving circuit further comprises a timing controller, the at least one first sub-pixel driving chip and the at least one second sub-pixel driving chip are connected to the timing controller respectively, the timing controller enables the first sub-pixel driving chip and the second sub-pixel driving chip for the same corresponding pixel to apply driving voltages to the sub-pixels in the corresponding pixel simultaneously.

9. The display device of claim 8, wherein the four sub-pixels in each pixel are a red sub-pixel, a green sub-pixel, a blue sub-pixel and a white sub-pixel respectively.

10. The display device of claim 8, wherein in each pixel in the pixel array, the sub-pixels are arranged side by side in one row in the pixel array; the at least one first sub-pixel driving chip each is connected to two sub-pixels in each corresponding pixel, and the at least one second sub-pixel driving chip each is connected to the other two sub-pixels in each corresponding pixel.

* * * * *